US006390745B1

(12) United States Patent
Coltea

(10) Patent No.: US 6,390,745 B1
(45) Date of Patent: May 21, 2002

(54) RAILWAY BOXCAR FOR CARRYING BAGGED CEMENT

(75) Inventor: Daniel V. Coltea, Fort Worth, TX (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/457,514

(22) Filed: Dec. 8, 1999

(51) Int. Cl.[7] ..... B60P 7/08
(52) U.S. Cl. ..... 410/127; 410/129; 410/135
(58) Field of Search ..... 410/127, 128, 410/129, 131, 135; 105/355, 378

(56) References Cited

U.S. PATENT DOCUMENTS

| | | | | | |
|---|---|---|---|---|---|
| 986,810 | A | * | 3/1911 | Dixey | 410/135 |
| 2,220,436 | A | * | 11/1940 | Ziegler | 410/135 |
| 2,866,419 | A | * | 12/1958 | Candlin, Jr. | 410/135 |
| 2,885,221 | A | * | 5/1959 | Weeks | 410/128 |
| 3,073,261 | A | * | 1/1963 | Oglesby | 410/131 |
| 3,297,175 | A | * | 1/1967 | Gooding | 410/129 |
| 3,392,683 | A | * | 7/1968 | Loomis et al. | 410/127 |
| 6,017,175 | A | * | 1/2000 | Kassab et al. | 410/131 |

FOREIGN PATENT DOCUMENTS

| | | | | |
|---|---|---|---|---|
| WO | WO89/10857 | * | 11/1989 | 410/127 |

OTHER PUBLICATIONS

"Freight Cars" Tech Series, Simmons–Boardman Publishing Corp., Educational Division, 1997 Copyright (pp. 4–7).

* cited by examiner

*Primary Examiner*—Stephen T. Gordon
(74) *Attorney, Agent, or Firm*—Baker Botts L.L.P.

(57) ABSTRACT

A railway boxcar may be provided for transporting packaged products having generally uniform first and second perimeter dimensions. The railway boxcar may include a car body having an interior compartment defined in part by a floor and a plurality of sidewalls. In one embodiment, the floor may include a width which generally corresponds to a multiple of the first perimeter dimension and a length which generally corresponds to the sum of a second multiple of the first dimension and a third multiple of the second dimension. In another embodiment, a door opening may provide access to the interior compartment. The width of the door opening may generally correspond to a fourth multiple of the first perimeter dimension. In another embodiment, a panel assembly may be provided to selectively fill voids within the interior compartment. The panel assembly may include a plurality of elongate plates extending generally parallel with one another. A corrugated panel may also be provided between the two plates and extending generally parallel therewith. At least one gusset may be coupled with at least one of the elongate plates to reinforce the panel assembly.

17 Claims, 5 Drawing Sheets

RAILWAY BOXCAR FOR CARRYING BAGGED CEMENT

TECHNICAL FIELD OF THE INVENTION

The present invention relates generally to railway boxcars and, more particularly, to a railway boxcar for carrying bagged cement and similar types of lading.

BACKGROUND OF THE INVENTION

Railway boxcars may be used to transport commodities and products which require protection from the elements and from breakage. Various boxcars are designed to carry general freight including automobile parts, lumber, grocery products, appliances, and other bulk materials. Products are frequently shipped across great distances over varying terrain. Frequently, products will shift and settle during transit.

In order to facilitate the use of mechanical equipment for loading and unloading, products will often be loaded upon pallets and/or stacked upon one another. Steel straps and shrinkwrap are frequently used to secure products to one another and their supporting pallets. Generally these products are transported using standardized boxcars which may comply with one or more specifications of the American Association of Railroads.

SUMMARY OF THE INVENTION

Accordingly, a need has arisen in the art for an improved railway boxcar. The present invention provides a railway boxcar that substantially eliminates or reduces problems associated with the prior railway boxcars used to ship bagged cement and similar types of lading.

In accordance with the present invention, a railway boxcar may be provided for transporting packaged products having generally uniform first and second perimeter dimensions. The railway boxcar may include a car body having an interior compartment defined in part by a floor and a plurality of sidewalls. In one embodiment, the floor may include a width which generally corresponds to a multiple of the first perimeter dimension and a length which generally corresponds to the sum of a second multiple of the first dimension and a third multiple of the second dimension. In another embodiment a door opening may provide access to the interior compartment. The width of the door opening may generally correspond to a fourth multiple of the first perimeter dimension.

In yet another embodiment, a panel assembly may be provided to selectively fill voids within the interior compartment. The panel assembly may include a plurality of elongate plates extending generally parallel with one another. A corrugated panel may also be provided between the two plates and extend generally parallel therewith. At least one gusset may be coupled with at least one of the elongate plates to reinforce the panel assembly.

In still another embodiment, an elongate slot may be disposed within at least one elongate plate. A pin-type connector may be provided to couple the panel assembly with the railway boxcar. The elongate slot may cooperate with the pin-type connector to allow the panel assembly to be rotated from a first position in which the panel assembly is generally parallel with the sidewall, and a second position wherein the panel assembly is generally perpendicular to the sidewall.

Technical advantages of the present invention include a railway boxcar having a floor with a width and a length which generally correspond to respective multiples of first and second perimeter dimensions of packaged products to be transported therein. The length and width of the floor allow packaged products to be securely stored within the interior compartment during transit. Predetermined spacing between adjacent packaged products, gaps adjacent to each sidewall and a void space above the packaged products may allow for simplified loading/unloading.

Another technical advantage of the present invention includes a panel assembly removably attached to the boxcar to selectively fill void spaces adjacent to the sidewalls to prevent shifting and settling of package lading during transit.

BRIEF DESCRIPTION OF THE DRAWINGS

For a more complete understanding of the present invention and the advantages thereof, reference is now made to the following brief description, taken in conjunction with the accompanying drawings and detailed description, wherein like reference numerals represent like parts, in which.

DETAILED DESCRIPTION OF THE INVENTION

The preferred embodiments of the present invention and its advantages are best understood by referring now in more detail to FIGS. 1–6 of the drawings, in which like numerals refer to like parts.

Figure 1:
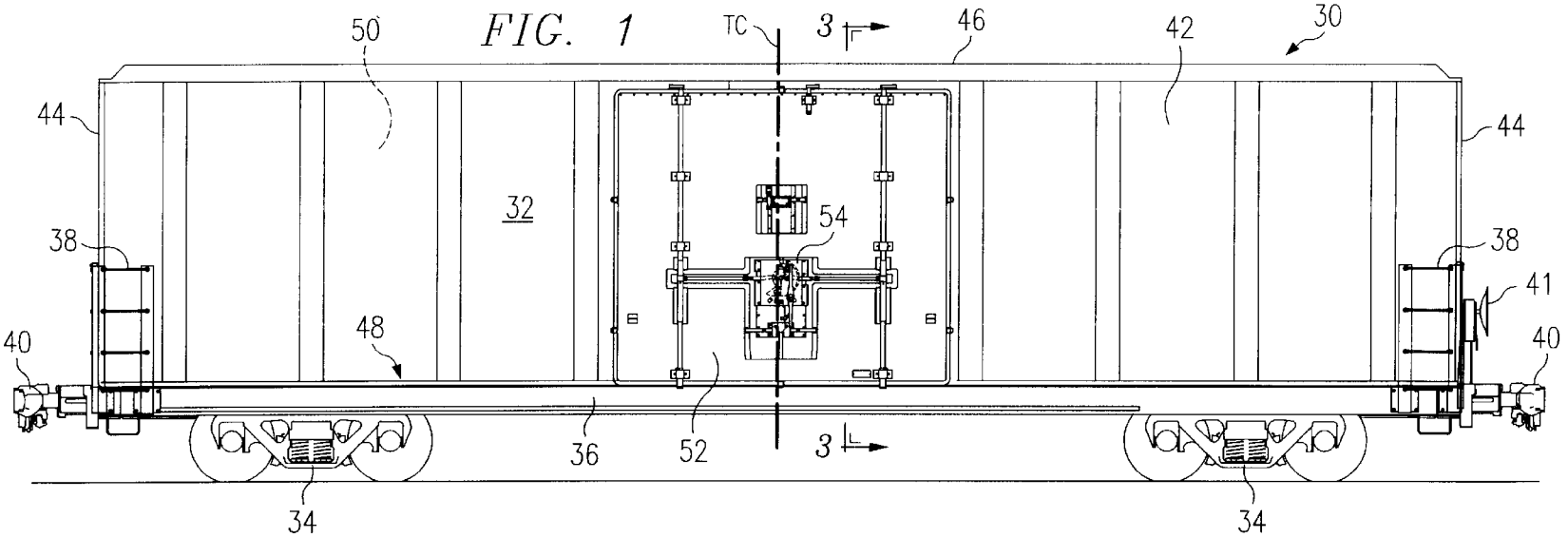
FIG. 1 is a schematic drawing with portions broken away showing a side view of a railway boxcar incorporating teachings of the present invention.
Figure 2:
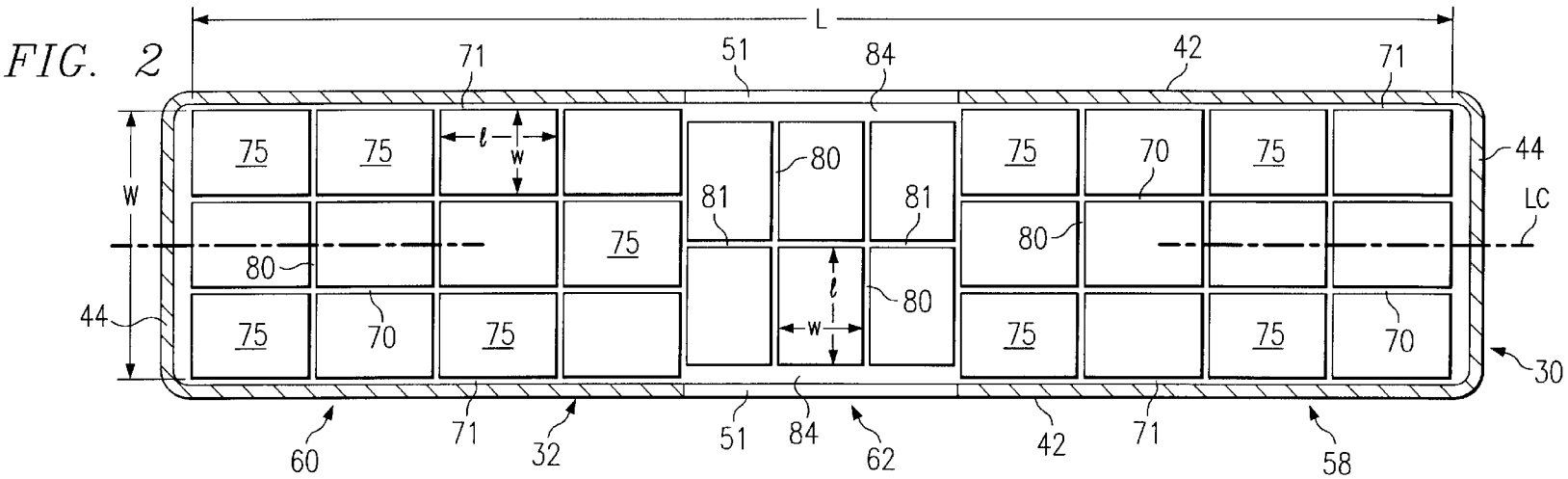
FIG. 2 is a schematic drawing with portions broken away showing a top view of a floor plan of the railway box car of FIG. 1.

A railway boxcar generally indicated by the reference numeral 30 is illustrated in FIG. 1. Car 30 is preferably configured and dimensioned to conform with specifications of the American Association of Railroads. Car 30 has a body 32 mounted to an underframe 36 which is supported at each end on trucks 34. Access ladders 38 are provided at each end of body 32. Additional features of railway boxcar 30 include coupler and draft gear assemblies 40 at each end of underframe 36, and hand brake wheel 41. Car 30 is generally symmetrical about transverse centerline TC.

Body 32 is a generally box-shaped structure including sidewalls 42, end walls 44, roof assembly 46 and floor 48. Body 32 at least partially encloses an interior compartment 50 which is accessible through a pair of doors 52. Only one door 52 is shown in FIG. 1. A respective handle 54 may be used to actuate each door 52 to provide access to interior compartment 50. Boxcar 30 may be used to transport commodities and products which require protection from the elements and/or against breakage. Boxcar 30 may be designed to carry general freight, or modified for the shipment of products including automobile parts, lumber, grocery products, appliances, and other bulk materials.

Referring to FIGS. 2–6 in the illustrated embodiment, railway boxcar 30 is configured for the shipment of packaged products 75. Packaged products 75 may include cement bags 74 assembled upon pallets 56. Each pallet 56 may be designed to have generally uniform perimeter dimensions. For example, in one embodiment, pallets 56 may be provided having a length l of forty-eight inches and a width w of forty inches. Since cement bags 74 are assembled upon pallets 56, the overall perimeter dimensions of packaged products 75 are approximately equal to the perimeter dimensions of pallets 56. In another embodiment, packaged products 75 may include any type of product which has been packaged for shipment, with or without pallets or other miscellaneous shipping components, including shrinkwrap, steel straps, cardboard and/or Styrofoam products, etc. Floor 48 is divided into end portions 58 and 60, and a mid-portion 62. The width of mid-portion 62 generally corresponds to the width of door opening 51.

Loading of packaged products 75 into interior compartment 50 is typically accomplished through door openings 51. In the illustrated embodiment, the width of door opening 51 is selected to be approximately equal to the width w of three packaged products 75 and corresponding pallets 56. Door opening 51 of the present invention may be wider than many railway boxcar door openings to accommodate loading of multiple packaged products across its width. The wide door opening 51 helps overcome difficulties encountered with the turning radii required for mechanical equipment such as a fork lift. Packaged products 75 may be loaded with the use of fork lifts, hand trucks or other mechanical equipment, as necessary. In order to accommodate the turning radius required for such equipment, mid-portion 62 of floor 48 is loaded subsequent to end portions 58 and 60. Packaged products 75 within end portions 58 and 60 are preferably installed within interior compartment 50 such that their respective lengths l run generally parallel with longitudinal centerline LC. Floor 48 is a generally rectangular configuration with a width W and a length L. Width W is designed to accommodate the width w of three pallets 56 across, with a predetermined spacing 70 between adjacent pallets 56. In one embodiment width W of floor 48 may be within the range of one hundred twenty to one hundred twenty-eight inches in order to accommodate three forty-inch wide pallets 56 across, with a spacing 70 of approximately four inches between each pallet 56. A gap 71 may also be left between sidewalls 42 and pallet 56, as desired. The width W of floor 48 may be significantly modified within the teachings of the present invention, to accommodate varying number and size pallets and provide adequate spacing 70 and/or gaps 71 therebetween.

Figure 3:
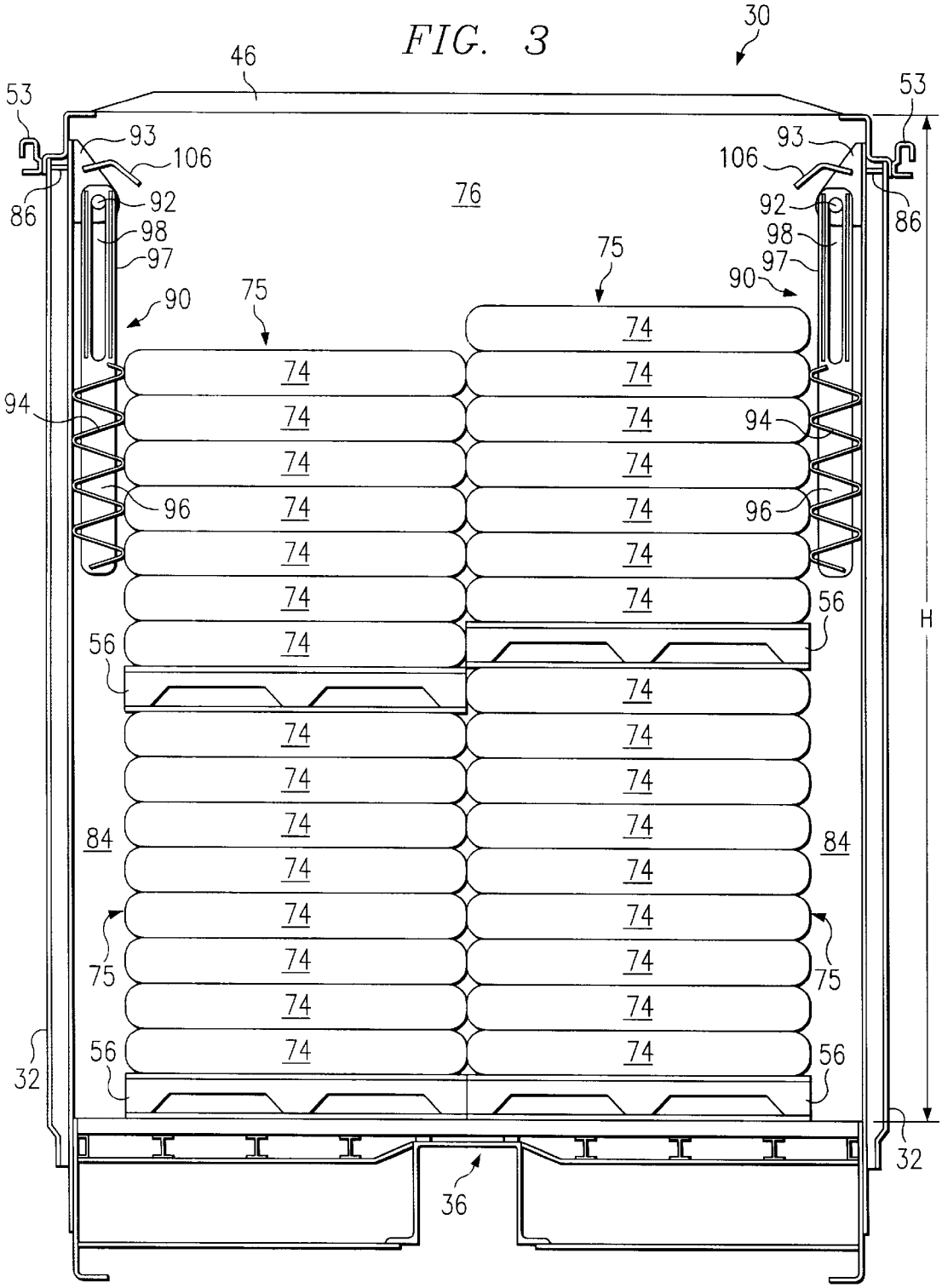
FIG. 3 is a schematic drawing with portions broken away showing a cross section taken along the lines 3—3 of FIG. 1.
Figure 4:
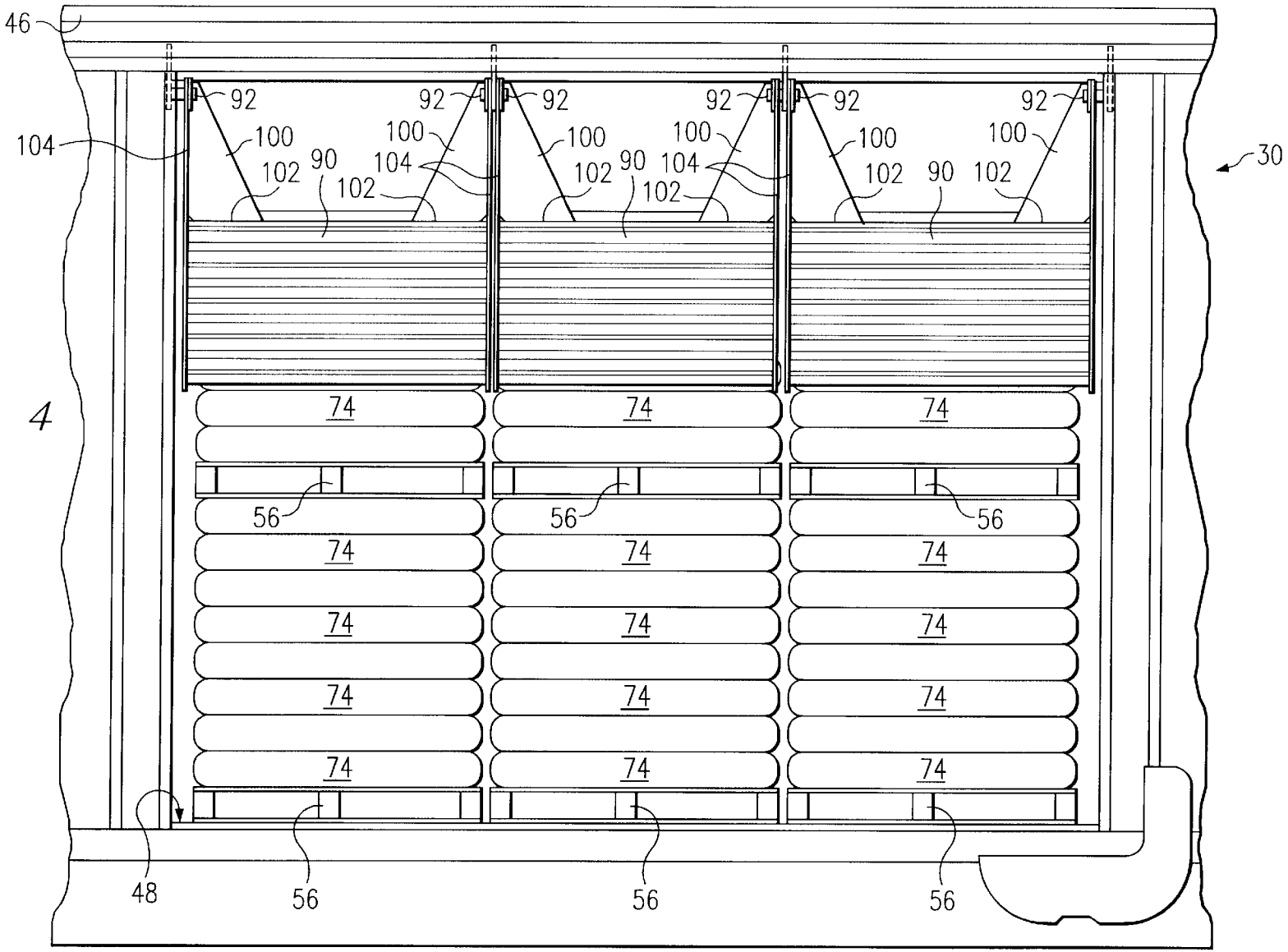
FIG. 4 is a schematic drawing with portions broken away showing a partial side view of the railway box car of FIG. 1 with a door in an open position.

As illustrated in FIGS. 3 and 4, multiple cement bags 74 may be placed upon each pallet 56, and multiple pallets 56 may be stacked upon one another, and/or other packaged products. The height of interior compartment 50 is generally designated by the reference letter H. The height to which packaged products 75 are stacked, and height H of interior compartment 50, may leave a void space 76 in the upper portion of interior compartment 50. Void space 76 may be a preselected value to prevent exceeding the load carrying capacity of the associated boxcar 30 and to maintain the center of gravity of boxcar 30 within a commercially reasonable limit, to enhance the stability, maneuverability, and cornering of boxcar 30. Void space 76 also accommodates simplified loading of interior compartment 50, and allows mechanical equipment the required clearance to lift pallets 56 in order to load and/or unload packaged products 75.

After loading end portions 58 and 60 of floor 48, mid-portion 62 may be loaded. As mid-portion 62 is loaded, mechanical equipment no longer has the benefit of a sufficient turning radius to maneuver pallets 56 within interior compartment 50. To simplify the loading process, pallets 56 within mid-portion 62 are loaded such that their lengths l lie generally perpendicular to longitudinal centerline LC. Mid-portion 62 has a generally rectangular configuration having a width which generally corresponds to width W of floor 48, and includes a length sufficient to accommodate three pallets 56 extending thereacross, with a predetermined spacing 80 between adjacent pallets 56. Width W accommodates two pallets, with spacing 81 therebetween. In the illustrated embodiment, pallets 56 are each forty-eight inches across, with a one-inch spacing 81 between, which leaves voids 84 between pallets 56 and sidewalls 42. Voids 84 may allow for shifting of pallets 56 and cement bags 74 during shipment, loading and unloading.

Referring now to FIGS. 3–6, in order to eliminate voids 84, panel assemblies 90 are preferably provided between respective doors 52 and adjacent packaged products 75. Any suitable mechanical connector, for example a pin-type connector, may be used to secure panel assemblies 90 to body 32. In the illustrated embodiment, panel assemblies 90 include corrugated panels 94 disposed between elongate plates 96 and operate to fill voids 84 to prevent damage to packaged products 75 caused by the shifting of the contents of boxcar 30 during transit. In another embodiment, panel assemblies 90 may include any combination of material and components having sufficient volume to fill spaces or gaps left between lading in a freight vehicle. Corrugated panels 94 may be fabricated from steel, fiberglass, composites, or other suitable material.

Figure 5:
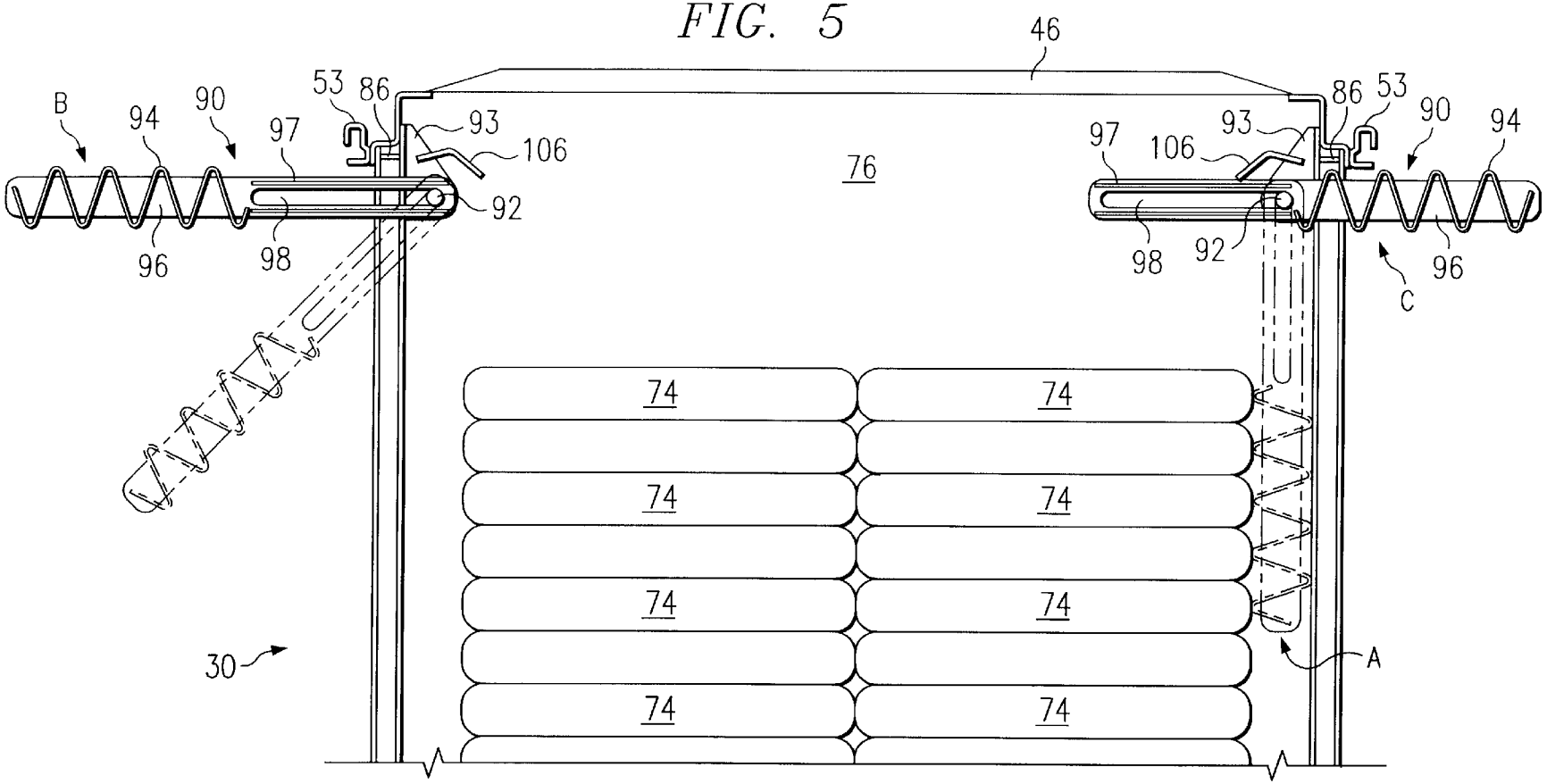
FIG. 5 is a schematic drawing with portions broken away showing a portion of the cross section of FIG. 3.
Figure 6:
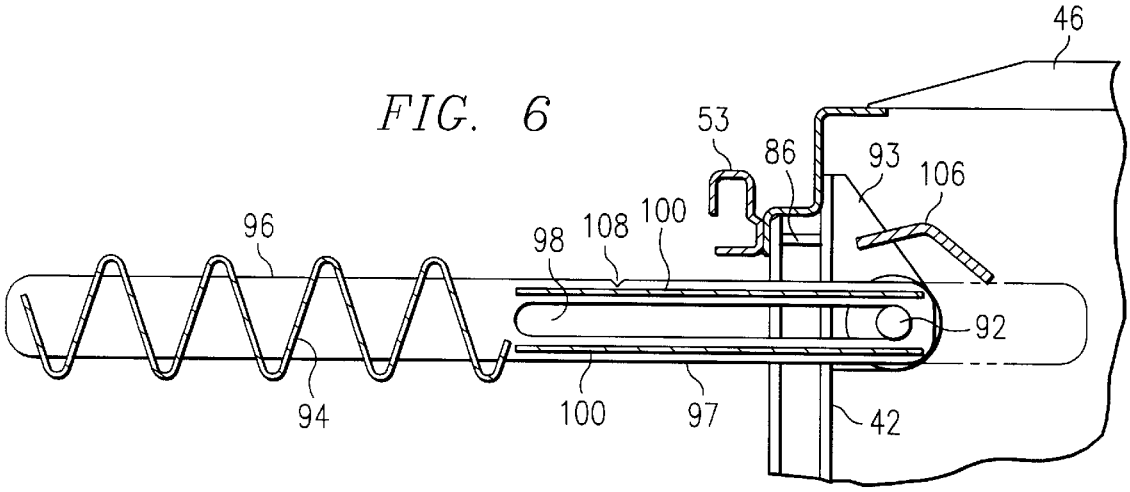
FIG. 6 is a schematic drawing with portions broken away illustrating the configuration of a panel assembly suitable for use with the railway boxcar of FIG. 1.

Pins 92 are preferably fixed and secured to car body 32 with mounting brackets 93. Panel assemblies 90 are preferably rotatably secured by pins 92 to allow for rotational movement of panel assemblies 90 with respect to an imaginary axis taken through pins 92. Each panel assembly 90 may be independently rotated between a first position A in which panel assembly 90 is generally parallel with sidewalls 42, to a second position B in which panel assemblies 90 are generally perpendicular to sidewalls 42. FIG. 5 illustrates various positions of panel assemblies 90 during rotation from first position A to second position B.

Elongate slots 98 are provided within each plate 96. Pins 92 are slidably secured within respective elongate slots 98. Elongate slots 98 run generally parallel along the length of plates 96 and occupy an upper portion 97 of plates 96. In the illustrated embodiment, elongate slots 98 extend approximately one-half of the length of plates 96. Corrugated panels 94 extend between lower portions of plates 96 to avoid an overlap between corrugated panels 94 and elongate slots 98.

Gussets 100 are preferably secured to plates 96 and extend along upper portion 97 of plates 96. The length of gussets 100 is selected to generally correspond with the length of elongate slots 98, in order to avoid overlap between gussets 100 and corrugated panels 94. Gussets 100 provide reinforcing strength to plates 96 and the entire panel assembly 90. In the illustrated embodiment, gussets 100 are of a generally triangular configuration with a first leg 104 secured to and running generally parallel with plates 96, and a second leg 102 extending away from plate 96 along corrugated panel 94. Gussets 100 may be formed from metal or any composite material with sufficient strength to reinforce panel assemblies 90. In the illustrated embodiment, two gussets 100 are attached to each plate 96 at upper portion 97. Each gusset 100 occupies a space within upper portion 97 adjacent to, and on either side of elongate slot 98. In another embodiment, a single gusset 100 may be provided for each plate 96. Alternatively, multiple gussets may be attached to each plate 96. It will be readily apparent to those skilled in the art that the number, size, and geometric configuration of gussets 100 may be significantly modified within the teachings of the present invention.

One or more safety stops 106 may be installed above upper portion 97 of plate 96. Each safety stop 106 is preferably configured and installed to prevent displacement of the associated panel assembly 90 from its first position A, slidably upward toward roof assembly 46. Conversely, when panel assembly 90 is rotated to its second position B, generally perpendicular to sidewalls 42, safety stop 106 allows panel assemblies 90 to be moved toward the interior of boxcar 30, to a third position C. In second position B of panel assembly 90, pin 92 occupies the upper most portion of elongate slot 98. As panel assembly 90 is moved toward its third position C, pin 92 moves toward a position within elongate slot 98 closest to corrugated panels 94. The third position of panel assemblies 90 is also illustrated in FIG. 5, and generally designated by the reference letter C.

During transit, panel assemblies 90 remain in their first position A extending downward and generally parallel with sidewalls 42. In order to load or unload boxcar 30, handle 54 is actuated and door 52 may be moved along door track 53 to an "open" position wherein door opening 51 is completely exposed. Panel assemblies 90 may then be rotated from their first position A to their second position B. As panel assemblies 90 are moved to their third position C, they are locked in place by safety stop 106 which prevents rotation of panel assemblies 90 with respect to pins 92. Notches 108 (FIG. 6) are provided within plates 96 which cooperate with safety stops 106 to secure respective panel assemblies 90 in their third positions C. Plates 96 may also engage door header 86, in order to maintain panel assemblies 90 in their third position C. Boxcar 30 may be loaded or unloaded with panel assemblies in their third positions C, such that panel assemblies 90 only minimally obstruct access to door openings 51. Prior to transit, panel assemblies 90 may be moved to their second position B, and subsequently rotated back to their first position A.

In the illustrated embodiment, three panel assemblies 90 are installed along each door opening 51. Multiple panel assemblies 90 minimize the weight and size of each individual panel assembly 90 to increase their mobility and ease of operation. Alternatively, in another embodiment, a single panel assembly may be provided spanning approximately the entire length or any fraction of door opening 51. Likewise, two panel assemblies may be provided or any number greater than three, depending upon the specific application. Three panel assemblies at each opening is also suitable for the illustrated embodiment due to the size and configuration of pallets 56. Since three pallets 56 are arranged across each door opening 51, the width of each panel assembly 90 generally corresponds to the width w of pallet 56.

Furthermore, in the illustrated embodiment, panel assemblies 90 are configured to occupy an upper portion of voids 84. Accordingly, panel assemblies 90 extend downward adjacent to the top five to six cement bags 74. In many instances, preventing shifting of only the uppermost cement bags 74 will be sufficient to prevent movement of all pallets 56 and packaged products 75. In another embodiment, panel assemblies 90 may be provided having a much greater or smaller length, depending upon the type of cargo contained in boxcar 30. Panel assemblies 90 may be provided to extend from pins 92 to floor 48, or any fraction of the length therebetween.

Railway boxcar 30 of the present invention is preferably custom configured to have a shorter length L and shorter width W than many railway boxcars. Width W is selected to correspond approximately to the width w of three pallets 56. Width W may be selected to be greater than three times the width w of packaged products 75 to allow for spacing 70 between adjacent pallets and gaps 71 between pallets 56 and sidewalls 42, as desired. Spacing 70 and gaps 71 may be significantly modified to accommodate various packaged products 75 or loading preferences. Accordingly, spacing 70 between adjacent pallets 56 need not be equal or uniform throughout boxcar 30. Similarly, gaps 71 between pallets 56 and adjacent sidewalls 42 need not be uniform or equal throughout boxcar 30.

Width W of floor 48 may be selected to be approximately equal to any multiple of the width w of pallets 56, within the teachings of the present invention. For example, in the illustrated embodiment, width W generally corresponds to a multiple approximately equal to three times the width w of pallet 56. In other words, width W is approximately equal to, but greater than three times the width w of pallet 56. Selecting a multiple exactly equal to three may not allow sufficient spacing 70 between each packaged product 75, to maneuver packaged products during loading and unloading. For purposes of illustration, selecting a multiple of 3.3 would allow an additional (0.3×40=12 inches) twelve inches of space to divide between spacings 70 and gaps 71. Accordingly, this would facilitate spacings 70 of four inches between each pallet, and gaps of two inches between each sidewall 42 and adjacent pallet 56. Alternatively, a multiple approximately equal to two, or four may be selected to accommodate two or four pallets respectively, across width W. Similar calculations will accommodate various suitable values for the overall length L of boxcar 30. The present invention encompasses various sizes of floor 48 based upon various sizes and quantities of packaged products 75.

Furthermore, the width w and length l of pallets 56 are variable depending upon the particular size of pallet selected. In another embodiment, packaged products may be placed and/or stacked within boxcar 30 without the use of pallets. For the purposes of this description, width w and length l correspond to the overall dimensions of the packaged products 75, after packaging. In the illustrated embodiment, the length and the width of the packaged products correspond to the length and width of pallets 56. The teachings of the present invention are suitable for use with any type of freight vehicle capable of transporting packaged products by air, land or sea.

In the illustrated embodiment, the weight of the concrete must be considered in designing the dimensions of boxcar 30. Since concrete is very dense, fewer packaged products 75 may be loaded upon each car in order to comply with applicable weight limitations. This requires a smaller overall "footprint" of floor 48. For example, the gross weight limit in Mexico is typically two hundred sixty-three thousand pounds per rail. In one embodiment, railway boxcar 30 may be designed to have a gross weight, or lightweight of sixty-three thousand pounds. This facilitates a "live load", or lading capacity of approximately two hundred thousand pounds. By minimizing the dimensions and, therefore, the overall weight of boxcar 30, additional "live load" may be carried within the overall maximum weight restrictions. Manufacturing costs and fuel consumption are also significantly reduced. The overall dimensions, W, L and H may be modified according to the density and quantity of the product being shipped.

Although the present invention has been described by several embodiments, various changes and modifications may be suggested to one skilled in the art. It is intended that the present invention encompasses such changes and modifications as fall within the scope of the present appended claims.

What is claimed is:

1. A railway boxcar for transporting packaged products having generally uniform first and second perimeter dimensions of approximately forty inches and approximately forty-eight inches, respectively, the boxcar comprising:

a car body having an interior compartment defined in part by a floor and a plurality of sidewalls;

the floor having a width generally corresponding to a first multiple of the first perimeter dimension;

the floor having a length generally corresponding to the sum of a second multiple of the first perimeter dimension and a third multiple of the second perimeter dimension; and wherein the first, second, and third multiples are preselected such that a predetermined number of packaged products may be transported within the interior compartment with minimal spacings between adjacent packaged products and the sidewalls to prevent shifting of the packaged products during transit and allow for maneuvering of the packaged products during loading and unloading.

2. The railway boxcar of claim 1 further comprising:

at least one of the plurality of sidewalls including a door opening having a width and a height, the door opening disposed within the car body to provide access to the interior compartment; and the width of the door opening being approximately equal to three times the second perimeter dimension.

3. The railway boxcar of claim 1 wherein the first multiple is approximately equal to three.

4. The railway boxcar of claim 3 wherein the second multiple is approximately equal to three.

5. The railway boxcar of claim 4 wherein the third multiple is approximately equal to eight.

6. The railway boxcar of claim 1, wherein the packaged products comprise cement bags.

7. The railway boxcar of claim 1, further comprising a panel assembly removably attached to the car body and operable to selectively fill voids within the interior compartment.

8. The railway boxcar of claim 7, wherein the panel assembly is rotatable between a first position in which the panel assembly is generally parallel with the floor, and a second position in which the panel assembly is generally perpendicular to the floor.

9. A railway boxcar for transporting packaged products having generally uniform first and second perimeter dimensions, the boxcar comprising:

a car body having an interior compartment defined in part by a floor and a plurality of sidewalls;

the floor having a width generally corresponding to a first multiple of the first perimeter dimension;

the floor having a length generally corresponding to the sum of a second multiple of the first perimeter dimension and a third multiple of the second perimeter dimension;

a panel assembly removably attached to the car body and operable to selectively fill voids within the interior compartment;

the panel assembly being rotatable between a first position in which the panel assembly is generally parallel with one of the plurality of sidewalls, and a second position in which the panel assembly is generally perpendicular to the one of the plurality of sidewalls; and wherein the panel assembly may be moved from the second position, toward the interior of the railway boxcar, to a third position in which a safety stop prevents rotation of the panel assembly with respect to a mechanical connector which couples the panel assembly to the railway boxcar.

10. The railway boxcar of claim 1, farther comprising:

a panel assembly removably attached to the car body and operable to selectively fill voids within the interior compartment;

wherein the panel assembly is rotatable between a first position in which the panel assembly is generally parallel with one of the plurality of sidewalls, and a second position in which the panel assembly is generally perpendicular to the one of the plurality of sidewalls; and wherein the panel assembly may be moved from the second position, toward the interior of the railway boxcar, to a third position in which a safety stop prevents rotation of the panel assembly with respect to a mechanical connector which couples the panel assembly to the railway boxcar.

11. A railway boxcar for transporting packaged products having generally uniform first and second parameter dimensions, the boxcar comprising:

a car body having an interior compartment defined in part by a floor and a plurality of sidewalls;

the floor having a width generally corresponding to a first multiple of the first perimeter dimension;

the floor having a length generally corresponding to the sum of a second multiple of the first perimeter dimension, and a third multiple of the second perimeter dimension;

a panel assembly removably attached to the car body and operable to selectively fill voids within the interior compartment; and wherein the panel assembly is rotatable between a first position in which the panel assembly is generally parallel with the floor, and a second position in which the panel assembly is generally perpendicular to the floor.

12. The railway boxcar of claim 11, further comprising:

at least one of the plurality of sidewalls having a door opening disposed therein and operable to provide access to the interior compartment; and the panel assembly disposed adjacent to the door opening and extending at least partially therethrough in the second position.

13. The railway boxcar of claim 11, wherein the panel assembly further comprises:

first and second elongate plates generally parallel with one another and having a corrugated panel disposed therebetween;

the corrugated panel extending generally parallel with the first and second elongate plates; and a mechanical connector rotatably coupling the panel assembly with one of the plurality of sidewalls.

14. The railway boxcar of claim 13, wherein the mechanical connector comprises a pin type connector having a mounting bracket coupling the pin type connector with the one of the plurality of sidewalls.

15. The panel assembly of claim 13, further comprising at least one gusset plate generally perpendicular to and extending along at least a portion of the elongate plates, to reinforce the panel assembly.

16. The panel assembly of claim 14, further comprising:

first and second elongate slots associated with upper portions of the first and second elongate plates, respectively, wherein the pin type connector is slidable along the first and second slots; and the elongate plates rotatable between a first position in which the elongate plates extend generally parallel with one of the plurality of sidewalls, and a second position in which the first and second elongate plates extend generally perpendicular to the one of the plurality of sidewalls.

17. The panel assembly of claim 13 wherein the first and second elongate plates include respective first and second notched openings operable to cooperate with a mechanical safety stop to secure the elongate plates in the second position.

* * * * *